US010713990B2

(12) United States Patent
Zou

(10) Patent No.: US 10,713,990 B2
(45) Date of Patent: Jul. 14, 2020

(54) DISPLAY SUBSTRATE, DISPLAY PANEL AND DISPLAY DEVICE

(71) Applicant: BOE TECHNOLOGY GROUP CO., LTD., Beijing (CN)

(72) Inventor: Xiangxiang Zou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/338,608

(22) PCT Filed: May 10, 2018

(86) PCT No.: PCT/CN2018/086286

§ 371 (c)(1),
(2) Date: Apr. 1, 2019

(87) PCT Pub. No.: WO2018/214738

PCT Pub. Date: Nov. 29, 2018

(65) Prior Publication Data

US 2019/0228695 A1 Jul. 25, 2019

(30) Foreign Application Priority Data

May 25, 2017 (CN) ..... 2017 1 0378849

(51) Int. Cl.

| | |
|---|---|
| ***G09G 3/20*** | (2006.01) |
| *G09G 3/36* | (2006.01) |
| *G09G 3/3266* | (2016.01) |

(52) U.S. Cl.

CPC ..... *G09G 3/20* (2013.01); *G09G 3/3266* (2013.01); *G09G 3/3674* (2013.01); (Continued)

(58) Field of Classification Search

CPC ..... G09G 3/20; G09G 2300/0408; G09G 2310/0267; G09G 2310/0286; G09G 2320/02; G09G 3/3266; G09G 3/3674

See application file for complete search history.

(56) References Cited

U.S. PATENT DOCUMENTS

2016/0147098 A1 5/2016 Isami
2016/0187686 A1 6/2016 Lou et al.
(Continued)

FOREIGN PATENT DOCUMENTS

CN 103454821 A 12/2013
CN 104503122 A 4/2015
(Continued)

OTHER PUBLICATIONS

International Search Report and Written Opinion dated Aug. 10, 2018 from State Intellectual Property Office of the P.R. China.

*Primary Examiner* — Stacy Khoo
(74) *Attorney, Agent, or Firm* — Dilworth & Barrese, LLP.; Michael J. Musella, Esq.

(57) ABSTRACT

A display substrate, a display panel and a display device are provided. The display substrate includes a display base, the display base is provided with a first effective display region, and the display base further includes an N-row multi-column pixel driving circuit disposed in the first effective display area, N being an integer greater than 1; the display substrate further includes a bent portion disposed on at least one side of the display base; the display substrate further including a gate driving circuit disposed on the bent portion; the gate driving circuit is configured to provide a gate driving signal to the N rows pixel driving circuits disposed on the first effective display region, respectively.

6 Claims, 4 Drawing Sheets

(52) U.S. Cl.
CPC ..... *G09G 2300/0408* (2013.01); *G09G 2310/0267* (2013.01); *G09G 2310/0286* (2013.01); *G09G 2320/02* (2013.01)

(56) References Cited

U.S. PATENT DOCUMENTS

| | | | |
|---|---|---|---|
| 2016/0284262 | A1 | 9/2016 | Qin et al. |
| 2018/0047358 | A1 | 2/2018 | Zhang et al. |
| 2019/0228695 | A1 | 7/2019 | Zou |

FOREIGN PATENT DOCUMENTS

| | | | |
|---|---|---|---|
| CN | 105489182 | A | 4/2016 |
| CN | 106653777 | A | 5/2017 |
| CN | 106952607 | A | 7/2017 |

DISPLAY SUBSTRATE, DISPLAY PANEL AND DISPLAY DEVICE

The present disclosure claims priority of Chinese Patent Application No. 201710378849.6 filed on May 25, 2017, the disclosure of which is hereby entirely incorporated by reference.

TECHNICAL FIELD

Embodiments of the present invention relates to a display substrate, a display panel, and a display device.

In a display substrate in a relevant art, a Gate On Array (GOA) region is disposed on the left and the right sides of the effective display area, respectively, and a design of narrow frame cannot be achieved. And at the same time, as a plurality of electronic elements and components are disposed in the GOA regions, possibility of electric defects is increased, causing yield rate to decrease and production cost to rise.

BACKGROUND

Summary

At least one embodiment of the present disclosure provides a display substrate, comprising a display base, the display base provided with a first effective display region, and the display base further comprising an N-row multi-column pixel driving circuit disposed in the first effective display area, N being an integer greater than 1; the display substrate further comprising a bent portion disposed on at least one side of the display base; the display substrate further comprising a gate driving circuit disposed on the bent portion; the gate driving circuit configured to provide a gate driving signal to the N rows pixel driving circuits disposed on the first effective display region, respectively.

In one embodiment of the present disclosure, the gate driving circuit comprise an N-stage gate driving unit; a b-th stage gate driving unit on the bent portion is connected to a b-th row pixel driving circuit on the display base through a b-th row gate driving signal output line; the bent portion is provided on a side of the display base; an angle between a segment of the b-th row gate driving signal output line on the bent portion and the side is within a predetermined angle range; b is a positive integer less than or equal to N; and the predetermined angle range is greater than 0° and less than 90°.

In one embodiment of the present disclosure, the display substrate further comprises an N-row multi-column pixel driving circuit; and the gate driving circuit disposed on the bent portion is further configured to provide a gate driving signal to the N rows of pixel driving circuits disposed on the bent portion, respectively.

In one embodiment of the present disclosure, the gate driving circuit disposed on the bent portion can comprise an N-stage gate driving unit; the (2n−1)-th gate driving unit and the 2n-th stage gate driving unit are disposed in the same row; the (2n−1)-th stage gate driving unit and the 2n-th stage gate driving unit are disposed between the (2n−1)-th row pixel driving circuit on the bent portion and the 2n-th row pixel driving circuit on the bent portion; a gate driving signal output terminal of the (2n−1)-th stage gate driving unit is connected to the (2n−1)-th row pixel driving circuit on the bent portion, and is configured to provide a gate driving signal to the (2n−1)-th row pixel driving circuit on the bent portion; a gate driving signal output terminal of the 2n-th gate driving unit is connected to the 2n-th row pixel driving circuit on the bent portion, and is configured to provide a gate driving signal to the 2n-th row pixel driving circuit on the bent portion; the (2n−1)-th stage gate driving unit is further connected to the (2n−1)-th row pixel driving circuit on the display base, and is configured to provide a gate driving signal to the (2n−1)-th row pixel driving circuit on the display base; the 2n-th gate driving unit is further connected to the 2n-th row pixel driving circuit on the display base, and is configured to provide a gate driving signal to the 2n-th row pixel driving circuit on the display base; and n is a positive integer and 2n is less than or equal to N.

In one embodiment of the present disclosure, the display substrate further comprises a light emitting layer covering the N-rows and multi-column pixel driving circuits and the gate driving circuit disposed on the bent portion.

In one embodiment of the present disclosure, the display substrate further comprises a light emitting layer covering the N-rows and multi-column pixel driving circuits disposed on the bent portion.

At least one embodiment of the present disclosure further provides a display panel comprising the display substrate as described above.

At least one embodiment of the present disclosure further provides a display device comprising the display panel as described above.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Unless otherwise defined, technical terms or scientific terms used herein shall be taken to mean the ordinary meaning of one of ordinary skill in the art to which the present invention pertains. The terms "first," "second," and the like used in the present invention do not denote any order, quantity, or importance, but are used to distinguish different components. Similarly, the words "comprising" or "including" and the like means that an element or object existing in front of the term include elements or objects existing after the term and their equivalents, but not exclude other elements or objects. The term "Connecting" or "coupling" and the like are not limited to physical or mechanical connections, but can include electrical connections, whether direct or indirect. The terms "up", "down", "left", "right" and etc. is only used to indicate the relative positional relationship, and when the absolute positions of the objects to be described are changed, the relative positional relationship may also change accordingly.

Figure 1:
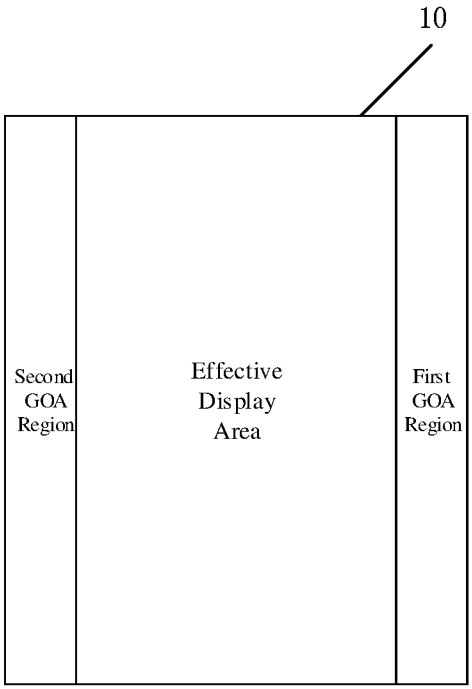
FIG. 1 is a schematic view of a display substrate in a relevant art.

As shown in FIG. 1, in a display substrate in a relevant, an effective display area is disposed in the middle of the display base 10. On the left and right sides of the display base 10, a first GOA (Gate On Array, a gate driving circuit disposed on an array substrate) region and a second GOA region are disposed the left side and the right side of the display substrate, respectively. Due to the presence of the GOA regions, a narrow frame design cannot be achieved. And further, as the area of the GOA region is small, and the number of TFTs (thin film transistors) and the number of metal traces to be disposed in the GOA region are large, and the probability of occurrence of defects in the GOA region, such as ESD (electrostatic protection), disconnection, shorting circuit, and etc., is increased. When there is a serious defect, the gate driving circuit in the GOA region cannot be operated any more, thereby greatly reducing the production yield and increasing the production cost.

A display substrate according to at least one embodiment of the present invention comprises a display base, the display base is provided with a first effective display region, and the display base further comprises an N-row multi-column pixel driving circuit disposed in the first effective display area, N being an integer greater than 1; the display substrate further comprises a bent portion disposed on at least one side of the display base; the display substrate further comprises a gate driving circuit disposed on the bent portion; the gate driving circuit is configured to provide a gate driving signal to the N rows of pixel driving circuits disposed on the first effective display region, respectively.

In the display substrate according to the embodiment of the present disclosure, the gate driving circuit is disposed on the bent portion (the bent portion is disposed on a side of the display base), thereby facilitating a narrow frame and increasing area of a GOA (Gate On Array, a gate driving circuit disposed on the array substrate) region, such that more space is provided for wiring, and shorting circuit of the GOA signal lines or other adverse risks is reduced.

In the embodiment of the present disclosure, by increasing the width of the GOA region and bending the GOA region to both sides of the display panel, the design of the narrow frame is adopted, and the area of the GOA region is increased.

For example, in actual operation, a first bent portion can be provided on a left side of the display base, and/or a second bent portion may be provided on a right side of the display base; or a corresponding bent portion may be provided on the upper side and/or the lower side of the display base, respectively.

For example, the angle between each bent portion and the display base can be 90°. And the angle can be 75°, 80° or other degrees, and the specific angle can be selected according to actual conditions. However, it should be noted that the angle between the bent portion and the display base cannot be 180°.

The present invention will be described by taking the first bent portion provided on the left side of the display base as an example.

Figure 2A:
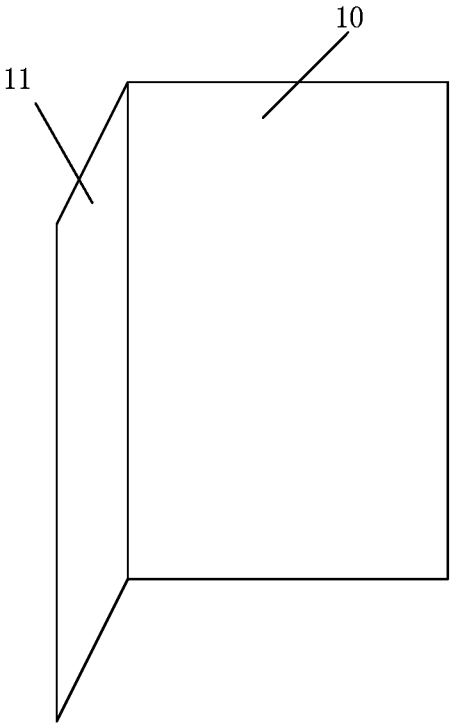
FIG. 2A is a schematic structural view of a display substrate according to an embodiment of the present disclosure.

As illustrated in FIG. 2A, the display substrate according to the an embodiment of the present disclosure comprises a display base 10, and the display base 10 is provided with a first effective display area (not illustrated in FIG. 1), and the display substrate further comprises an N-row multi-column pixel driving circuit (not illustrated in FIG. 1) disposed in the first effective display area; the display substrate further comprises a first bent portion 11 disposed on a left side of the display base;

the display substrate further comprises a first gate driving circuit (not illustrated in FIG. 1) disposed on the first bent portion 11;

the first gate driving circuit is configured to provide gate driving signals to the N rows of pixel driving circuits disposed on the first effective display region, respectively.

In the embodiment of the display substrate illustrated in FIG. 2A, the first gate driving circuit comprises an N-stage gate driving unit, and the first gate driving circuit configured to provide gate driving signals to the pixel driving circuit in the first effective display region is provided on the first bent portion, so that there is no need to reserve a GOA region for the first gate driving circuit on the display base 10, thus the first effective display region can cover almost the top side of the display base, which helps to achieve narrow frame; and further, the area of the GOA region can be increased, the risk of short circuit of GOA signal lines or other defects of GOA can be greatly reduced.

Figure 2B:
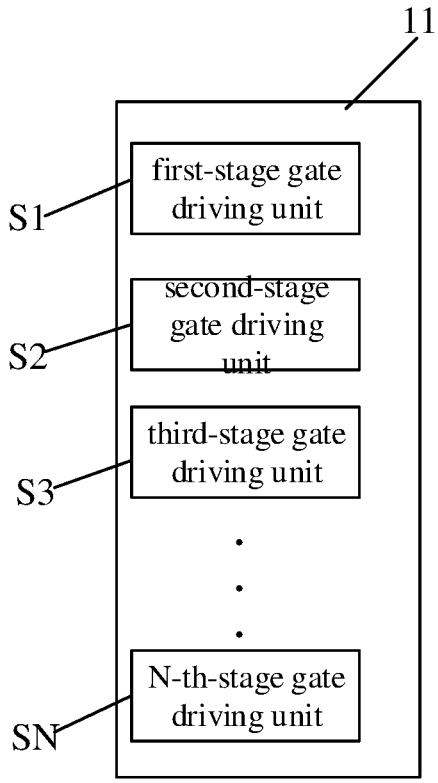
FIG. 2B is a schematic structural view of a display substrate according to an embodiment of the present disclosure, wherein a first portion is disposed on a oats driving circuit.

As illustrated in FIG. 2B, in the one embodiment of the present disclosure, the display substrate comprises a first gate driving circuit disposed on the first bent portion 11;

In FIG. 2B, reference numeral S1 is a first-stage gate driving unit comprised in the first gate driving circuit; and reference sign S2 is a second-level gate driving unit comprised in the first gate driving circuit, and reference sign S3 is the third stage gate driving unit comprised in the first gate driving circuit is S3; reference sign SN is the Nth gate driving unit comprised in the first gate driving circuit.

Figure 2C:
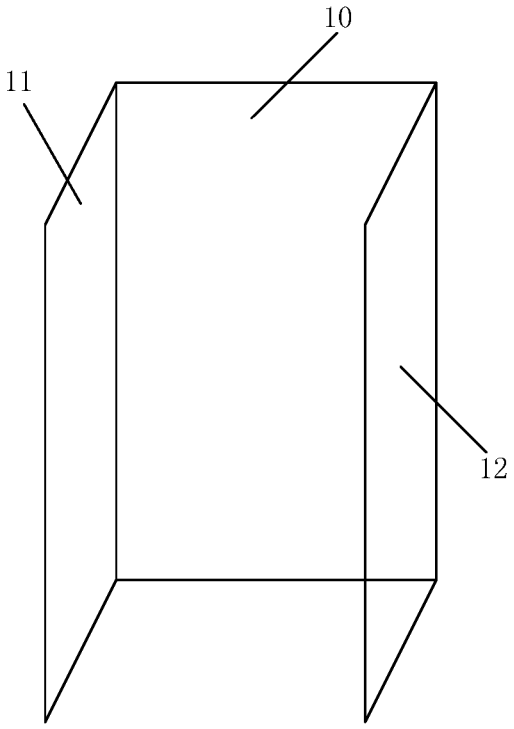
FIG. 2C is a schematic view illustrating a third bent portion further provided on the basis of FIG. 2A.

For example, in one embodiment according to the present disclosure, when the number of columns of the pixel driving circuits provided in the first effective display area of the display substrate is relatively large, on the basis of the embodiment illustrated in FIG. 2A and FIG. 2B, as illustrated in FIG. 2C, a second bent portion 12 can be disposed on the right side of the display base 10, and a second gate driving circuit (not illustrated in FIG. 2C) is disposed on the second bent portion 12; the second gate driving circuit also comprise an N-stage gate driving unit;

at this time, it is assumed that the number of columns of the pixel driving circuits comprises in the first effective display region is 2M columns (M is a positive integer); gate driving signals are provided to the left M column pixel driving circuit in the first effective display region through the first gate driving circuit, and gate driving signals are provided to the right M column pixel driving circuit in the first effective display region through the second gate driving circuit.

For example, in an embodiment according to the present disclosure, the gate driving circuit comprise an N-stage gate driving unit;

the b-th stage gate driving unit on the bent portion is connected to the b-th row pixel driving circuit on the display base through the b-th row gate driving signal output line;

the bent portion is provided on a side of the display base; and the angle between the segment of the b-th row gate driving signal output line on the bent portion and the side is within a predetermined angle range; b is a positive integer less than or equal to N.

The predetermined angle range is greater than 0° and less than 90°. For example, the angle between the segment of the b-th row gate driving signal output line on the bent portion and the side can be 45°.

In actual operation, each stage of gate driving units disposed on the bent portions of the respective stages is connected to the corresponding row pixel driving circuit on the display base through a corresponding row gate driving signal output lines. For example, in the embodiment of the present invention, the segments of the corresponding row gate driving signal output lines on the bent portion are oblique, that is, the segments of the respective row gate driving signal output lines on the bent portion are not parallel to the top side or the bottom side of the display base. Such a configuration is for obtaining a larger radius of curvature, and to greatly improve the bending performance of the gate driving signal output lines of each row where the gate driving signal output lines are bent, so that the respective row gate driving signal output lines are not easily broken.

In the display panel according to the embodiments of the present disclosure, the gate driving signal output line has a larger radius of curvature than the gate driving signal output line in a relevant art. According to the geometric principle, if the oblique angle is 45 degrees, the radius of curvature of the gate driving signal output line in the display panel according to the embodiments of the present disclosure is about 1.4 times the radius of curvature of the gate driving signal output line in the relevant art. Since the radius of curvature of the signal line is determined under current process conditions, the probability of breakage of the metal trace (the gate driving signal output line is a metal trace) is increased when a bending degree of the metal trace is greater than the bending degree corresponding to the radius of curvature. With the oblique segment design of the embodiment of the present invention, the radius of curvature can be increased by 40%, which greatly improves the bending performance of the curved portion of the display panel.

Figure 3:
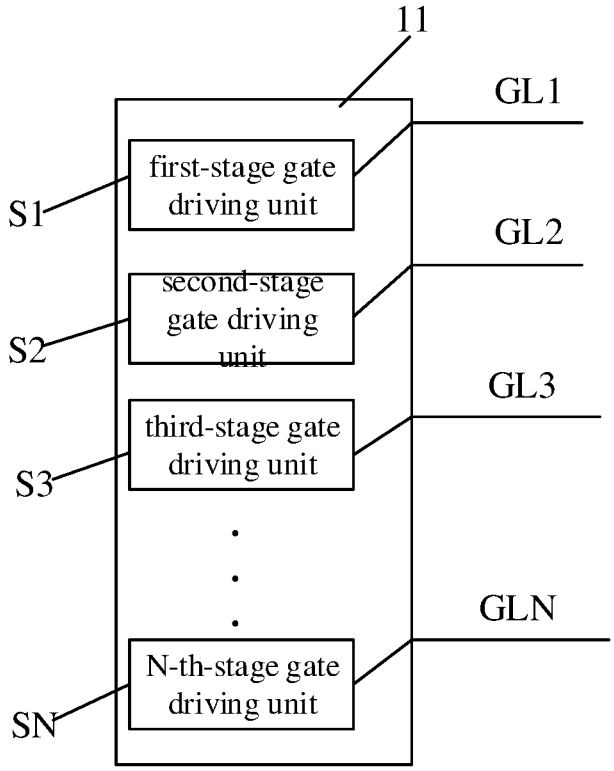
FIG. 3 is a schematic view of a gate driving signal output line for each stage of the gate driving unit comprised in the gate driving circuit on the first bent portion of the display substrate according to an embodiment of the present invention.

As illustrated in FIG. 3, on the basis of the display substrate illustrated in FIG. 2B, the first-stage gate driving unit 51 comprised in the first gate driving circuit on the first bent portion 11 is connected to the first row pixel driving circuit on the display base through a first row gate driving signals output line GL1 (the display base and the first row pixel driving circuit are not shown in FIG. 3);

the second gate driving unit S2 comprised in the first gate driving circuit on the first bent portion 11 is connected to the second row pixel driving circuit (not illustrated in FIG. 3) on the display base through the second row gate driving gate signals output line GL2;

the N-th gate driving unit SN comprised in the first gate driving circuit on the first bent portion 11 is connected to the N-th row pixel driving circuit (not illustrated in FIG. 3) on the display base through the N-th row gate driving gate signals output line GLN.

As can be seen from FIG. 3, the segments of the respective gate driving signal output lines on the first bent portion 11 are oblique, so that good bending characteristics can be obtained.

For example, the display substrate further comprises an N-row multi-column pixel driving circuit disposed on the bent portion; the gate driving circuit disposed on the bent portion is further configured to provide gate driving signals to the N row pixel driving circuit disposed on the bent portion, respectively.

That is, in one embodiment of the present disclosure, the effective display area is also provided on the bent portion, and the display area is correspondingly increased.

For example, on the basis of the display substrate illustrated in FIG. 2C, a second effective display area can be provided on the first bent portion 11, and a third effective display area can be provided on the second bent portion 12.

For example, the gate driving circuit disposed on the bent portion can comprise an N-stage gate driving unit;

the (2n−1)-th gate driving unit and the 2n-th stage gate driving unit are disposed in the same row;

the (2n−1)-th stage gate driving unit and the 2n-th stage gate driving unit are disposed between the (2n−1)-th row pixel driving circuit on the bent portion and the 2n-th row pixel driving circuit on the bent portion;

a gate driving signal output terminal of the (2n−1)-th stage gate driving unit is connected to the (2n−1)-th row pixel driving circuit on the bent portion, and is configured to provide a gate driving signal to the (2n−1)-th row pixel driving circuit on the bent portion;

a gate driving signal output terminal of the 2n-th gate driving unit is connected to the 2n-th row pixel driving circuit on the bent portion, and is configured to provide a gate driving signal to the 2n-th row pixel driving circuit on the bent portion;

The (2n−1)-th stage gate driving unit is further connected to the (2n−1)-th row pixel driving circuit on the display base, and is configured to provide a gate driving signal to the (2n−1)-th row pixel driving circuit on the display base;

The 2n-th gate driving unit is further connected to the 2n-th row pixel driving circuit on the display base, and is configured to provide a gate driving signal to the 2n-th row pixel driving circuit on the display base;

n is a positive integer and 2n is less than or equal to N.

Figure 4:
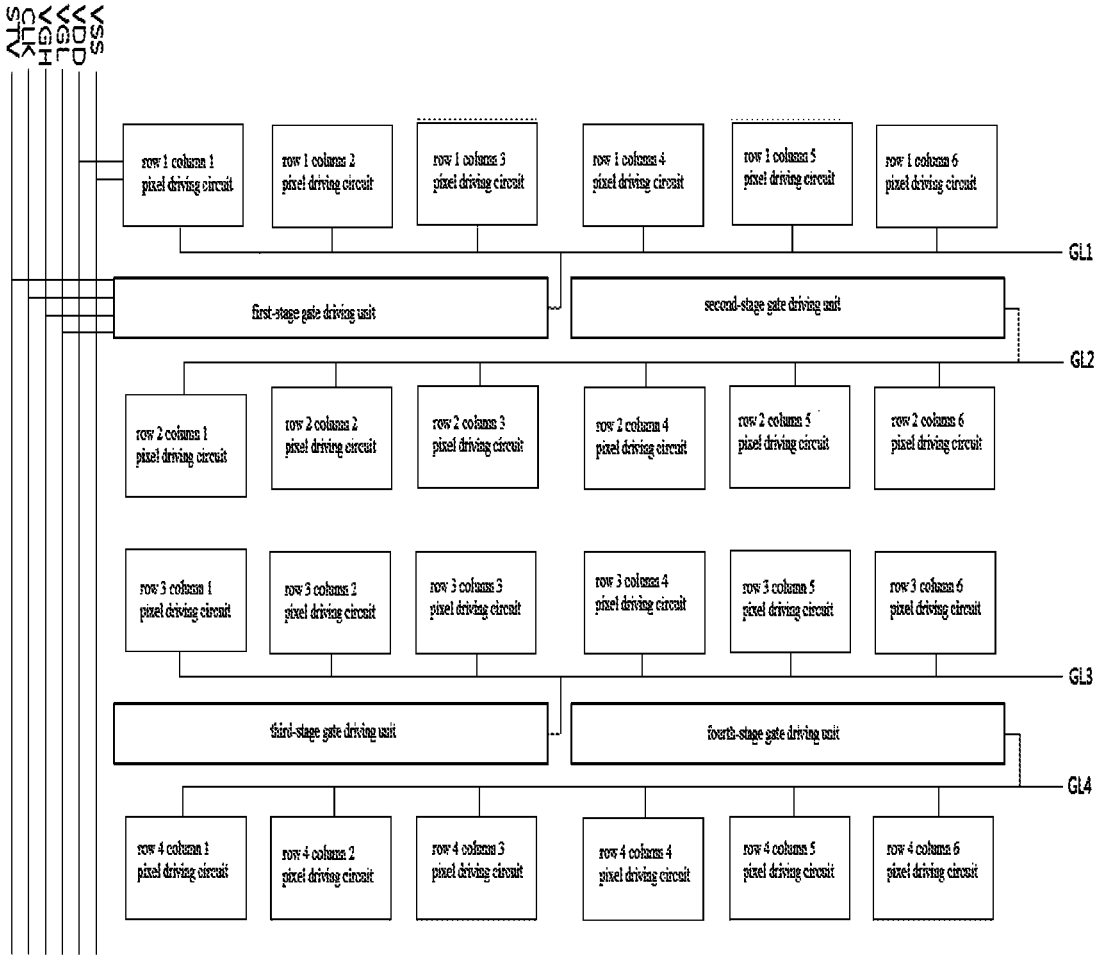
FIG. 4 is a structural view of a gate driving circuit and a pixel driving circuit provided on a bent portion comprised in a display substrate according to an embodiment of the present invention.

As illustrated in FIG. 4, when both the gate driving circuit and the pixel driving circuit are disposed on the first bent portion (not illustrated in FIG. 4), FIG. 4 just illustrates the four-stage gate driving units comprised in the gate driving circuit and 4-row-6-column pixel driving circuit disposed on the first bent portion;

In FIG. 4, all the column pixel driving circuits in the first row disposed on the first bent portion are connected to the first-stage gate driving unit through the first row gate driving signal output line GL1;

All the column pixel driving circuits in the second row disposed on the first bent portion are connected to the second-stage gate driving unit through the second row gate driving signal output line GL2;

All the column pixel driving circuits in the third row disposed on the first bent portion are connected to the third-stage gate driving unit through the third row gate driving signal output line GL3;

All the column pixel driving circuits in the fourth row disposed on the first bent portion are connected to the fourth-stage gate driving unit through the fourth row gate driving signal output line GL4;

The first stage gate driving unit and the second stage gate driving unit are disposed in the same row, and both the first stage gate driving unit and the second stage gate driving unit are disposed between all the all column pixel driving circuits in the first row and all the column pixel driving circuits in the second row;

The third-stage gate driving unit and the fourth-stage gate driving unit are located in the same row, and both the third-stage gate driving unit and the fourth-stage gate driving unit are disposed between all the all column pixel driving circuits in the third row and all the column pixel drive circuits in the fourth row.

In FIG. 4, VSS is the first low level, VGL is the second low level, VDD is the first high level, VGH is the second high level, CLK is the clock signal, and STV is the start signal.

In actual operation, the arrangement of the gate driving unit and the pixel driving circuit on the bent portion as illustrated in FIG. 4 is adopted, which facilitates wiring and reasonable circuit arrangement.

In FIG. 4, only one arrangement of the pixel driving circuit and the gate driving circuit on the bent portion is illustrated. In actual operation, other arrangements can be adopted, which are not limited herein.

For example, the display substrate according to one embodiment of the present disclosure further comprises a light emitting layer covering the N-rows and multi-column pixel driving circuits and the gate driving circuit disposed on the bent portion. The arrangement of the light-emitting layer is relatively simple, and it is not necessary to arrange the light-emitting layer so as to make the light-emitting layer not overlap the gate drive circuit.

For example, the display substrate according to one embodiment of the present disclosure further comprises a light emitting layer covering the N-rows and multi-column pixel driving circuits disposed on the bent portion. In actual operation, the light-emitting layer can non-overlap the gate driving circuit, and does not affect the gate driving circuit due to coupling.

At least one embodiment of the present disclosure provides a display panel comprising a display substrate as mentioned above.

At least one embodiment of the resent disclosure provides a display device comprising a display panel as mentioned above.

The foregoing are merely exemplary embodiments of the invention, but are not used to limit the protection scope of the invention. The protection scope of the invention shall be defined by the attached claims.

The invention claimed is:

1. A display substrate, comprising a display base, the display base provided with a first effective display region, and the display base further comprising a plurality of pixel driving circuits arranged in N rows and multiple columns in the first effective display area, N being an integer greater than 1; the display substrate further comprising a bent portion disposed on at least one side of the display base; the display substrate further comprising a gate driving circuit disposed on the bent portion; the gate driving circuit configured to provide a gate driving signal to the N rows pixel driving circuits disposed on the first effective display region, respectively, wherein the display substrate further comprises a plurality of pixel driving circuits arranged in N rows and multiple columns on the bent portion, and the gate driving circuit is further configured to provide a gate driving signal to the N rows of pixel driving circuits disposed on the bent portion, respectively;

the gate driving circuit comprise N stages of gate driving units;

a (2n−1)-th stage gate driving unit and a 2n-th stage gate driving unit are disposed in a same row; the (2n−1)-th stage gate driving unit and the 2n-th stage gate driving unit are disposed between a (2n−1)-th row pixel driving circuit on the bent portion and a 2n-th row pixel driving circuit on the bent portion;

a gate driving signal output terminal of the (2n−1)-th stage gate driving unit is connected to the (2n−1)-th row pixel driving circuit on the bent portion, and is configured to provide a gate driving signal to the (2n−1)-th row pixel driving circuit on the bent portion;

a gate driving signal output terminal of the 2n-th stage gate driving unit is connected to the 2n-th row pixel driving circuit on the bent portion, and is configured to provide a gate driving signal to the 2n-th row pixel driving circuit on the bent portion;

the (2n−1)-th stage gate driving unit is further connected to a (2n−1)-th row pixel driving circuit on the display base, and is configured to provide a gate driving signal to the (2n−1)-th row pixel driving circuit on the display base;

the 2n-th stage gate driving unit is further connected to a 2n-th row pixel driving circuit on the display base, and is configured to provide a gate driving signal to the 2n-th row pixel driving circuit on the display base; and n is a positive integer and 2n is less than or equal to N.

2. The display substrate according to claim 1, wherein the gate driving circuit comprise an N-stage gate driving unit;

a b-th stage gate driving unit on the bent portion is connected to a b-th row pixel driving circuit on the display base through a b-th row gate driving signal output line;

the bent portion is provided on a side of the display base;

an angle between a segment of the b-th row gate driving signal output line on the bent portion and the side is within a predetermined angle range; b is a positive integer less than or equal to N; and the predetermined angle range is greater than 0° and less than 90°.

3. The display substrate according to claim 1, wherein the display substrate further comprises a light emitting layer covering the N-rows and multi-column pixel driving circuits and the gate driving circuit disposed on the bent portion.

4. The display substrate according to claim 1, wherein the display substrate further comprises a light emitting layer covering the N-rows and multi-column pixel driving circuits disposed on the bent portion.

5. A display panel, comprising the display substrate according to claim 1.

6. A display device, comprising the display panel according to claim 5.

* * * * *